United States Patent [19]

Rado

[11] 4,194,480

[45] Mar. 25, 1980

[54] VOLTAGE DISTRIBUTOR FOR A SPARK IGNITION ENGINE

[75] Inventor: William G. Rado, Ann Arbor, Mich.

[73] Assignee: Ford Motor Company, Dearborn, Mich.

[21] Appl. No.: 862,707

[22] Filed: Dec. 21, 1977

[51] Int. Cl.[2] ..... F02P 1/00

[52] U.S. Cl. ..... 123/148 ND; 123/146.5 A; 123/148 E

[58] Field of Search ..... 123/148 E, 146.5 A, 123/148 DK, 148 ND; 200/19 M, 19 R, 117 D

[56] References Cited

U.S. PATENT DOCUMENTS

| | | | |
|---|---|---|---|
| 3,621,826 | 11/1971 | Chrestensen | 123/148 E |
| 3,757,755 | 9/1973 | Carner | 123/117 D |
| 3,886,102 | 8/1975 | Van Neff | 123/117 D |
| 3,955,723 | 5/1976 | Richards | 123/148 E |
| 4,019,486 | 4/1977 | Siegle | 123/148 E |
| 4,044,747 | 8/1977 | Longstaff | 123/148 E |

*Primary Examiner*—Ronald B. Cox

*Attorney, Agent, or Firm*—Robert W. Brown; Clifford L. Sadler

[57] ABSTRACT

A voltage distributor for a spark ignition internal combustion engine. The distributor supplies voltage to spark plugs in a sequence corresponding to the firing order of the engine. The distributor is not driven by the camshaft of the engine in the conventional manner, but rather uses steering logic and a decoder in conjunction with a multiple position switch and trigger pulses to produce the voltage distribution. The steering logic and decoder may comprise a stepper motor and stepper motor decoder circuit operated by trigger pulses to produce rotation of a rotary switch or, alternatively, may comprise a binary counter and associated decoder for controlling relay switches.

1 Claim, 4 Drawing Figures

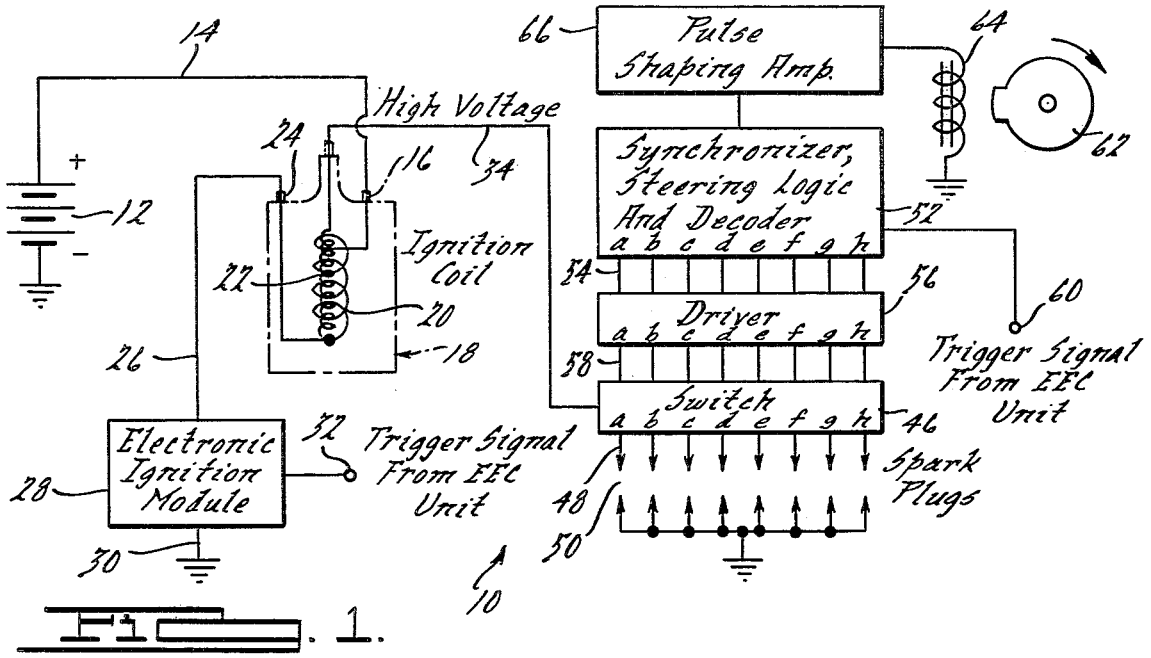
FIG. 1.
FIG. 3.
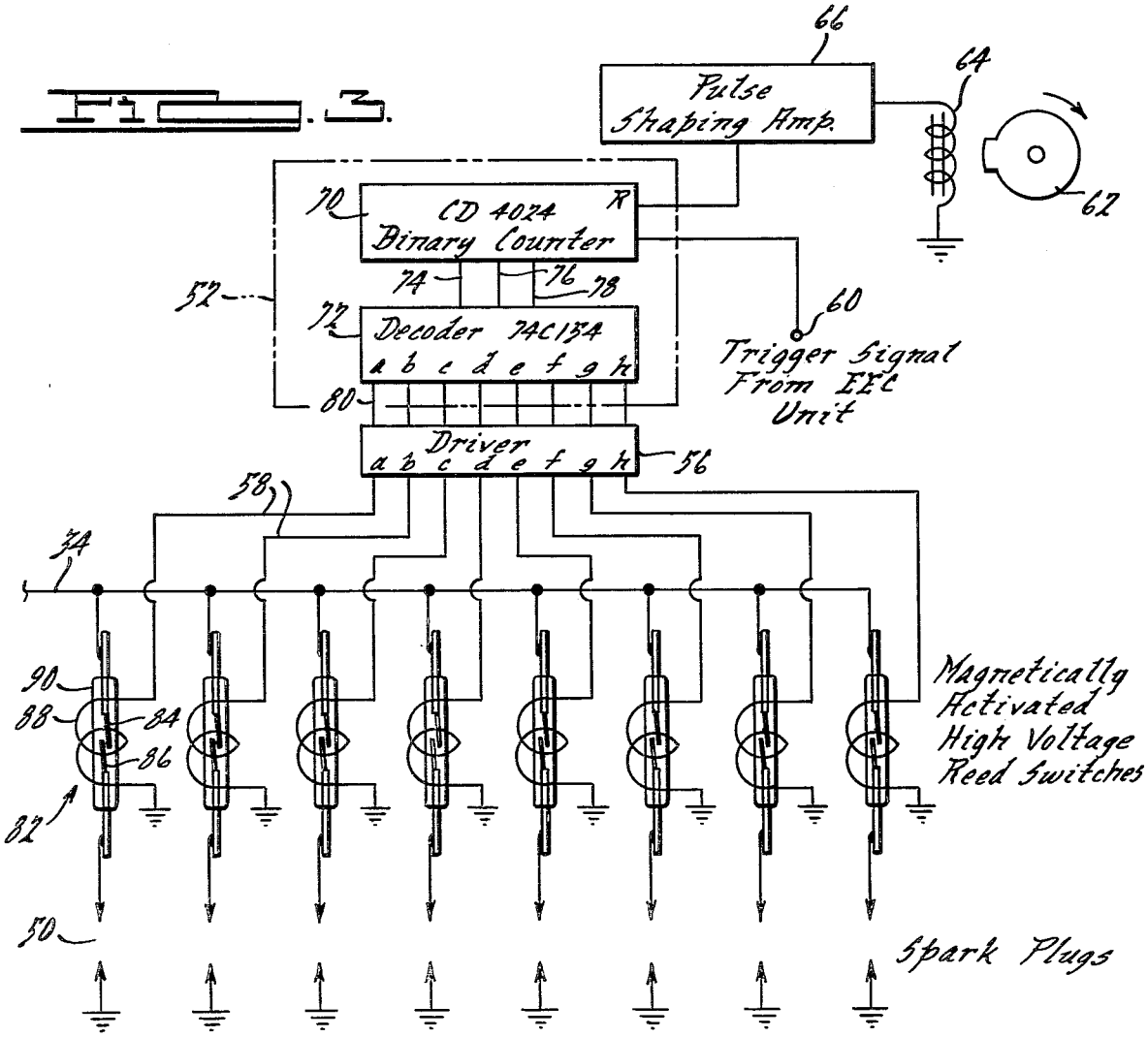

VOLTAGE DISTRIBUTOR FOR A SPARK IGNITION ENGINE

BACKGROUND

This invention relates to a voltage distributor for a spark ignition internal combustion engine. More particularly, it relates to a voltage distributor that is not driven by the camshaft of the engine as are voltage distributors of conventional construction. Instead, the distributor of the invention may be located at any convenient location within the engine compartment of a motor vehicle, subject only to the limitation that electrical leads must extend from the distributor to the various engine spark plugs.

DESCRIPTION OF THE PRIOR ART

In the conventional voltage distributor for a motor vehicle internal combustion engine, a camshaft of the engine, through suitable gearing arrangements, drives a distributor shaft mounted within a suitable distributor housing. The distributor housing may have included within it distributor breaker points or a magnetic pick-up device for the generation of control signals. The control signals are required to produce periodic interruption of the current flowing through the primary winding of an ignition coil, thereby, to generate high voltage pulses in the secondary winding thereof. The high voltage pulses in the secondary winding of the ignition coil are fed, via a lead wire, to a central electrode of the distributor. A rotary switching device in the distributor then distributes this high voltage to the various distributor electrodes that are connected to the individual spark plugs of the engine.

Various modifications of this basic voltage generation and distribution system have been proposed by others. For example, U.S. Pat. Nos. 3,605,712 to E. H. Ford; 3,958,543 to K. Senda; and 3,998,193 to A. P. Ives et al each disclose an ignition system wherein the angular position of a rotating shaft is sensed and the resulting information is used to advance or retard an engine's ignition timing. However, in none of these disclosed systems is crankshaft position information used, without a direct mechanical connection between the crankshaft or camshaft and a distributor, to provide ignition voltage distribution.

U.S. Pat. No. 3,050,597 to C. Yakem is representative of devices wherein a rotary switch is driven by a motor that makes and breaks contacts as a rotor is turned by the motor.

SUMMARY OF THE INVENTION

The voltage distributor of the invention is advantageous in that it may be placed anywhere in the engine compartment of a motor vehicle thus improving engine packaging and permitting engine design flexibility. Direct mechanical linkage of the distributor with the engine's camshaft or crankshaft and dependence on the camshaft or crankshaft for facilitating the ignition function is eliminated.

The invention provides a distributor for the high voltage required in connection with spark ignition internal combustion engines to produce spark discharges within the spark plugs of the engine. The distributor is intended for use with engines having a plurality of combustion chambers and at least one spark plug for each of these chambers. An ignition coil having primary and secondary windings is provided. The output lead from the ignition coil secondary winding is supplied to a multiple position switch that sequentially connects a plurality of switch output leads with the secondary winding output lead. This involves a sequential making and breaking of electrical contact between the secondary winding output lead and the distributor switch output leads which are connected to the various engine spark plugs. The sequential making and breaking of electrical contact occurs in accordance with the firing order of the engine with which the voltage distributor is associated.

Trigger means, coupled to the ignition coil primary winding, cause voltage pulses to occur on the secondary winding output lead in the usual or conventional manner. The voltage pulses have a magnitude sufficient to produce a spark discharge in the spark plug to which the secondary winding output lead is electrically connected through the distributor switch. The trigger means generates trigger pulses at a repetition frequency equal to the repetition frequency of the voltage pulses. A steering logic and decoder means, which also may include synchronizing means, is provided for controlling the distributor switch in response to the trigger pulses. The steering logic and decoder means causes the sequential making and breaking of electrical contact in the distributor switch in a sequence corresponding to the engine firing order and without direct mechanical connection between the distributor and the camshaft or crankshaft of the engine.

The steering logic and decoder means may take the form of a stepper motor and stepper motor logic decoder supplied with the trigger pulses. The distributor switch device then may constitute a rotary switch driven in steps by the stepper motor. Alternatively, the steering logic and decoder means may comprise a binary counter supplied with the trigger pulses and a binary-to-line decoder coupled to the binary counter. The distributor switch device then may comprise a plurality of relay switches coupled to the spark plugs and controlled by the line outputs of the decoder.

The invention may be better understood by reference to the detailed description which follows and to the drawings.

BRIEF DESCRIPTION OF THE DRAWINGS

FIG. 1 is a schematic electrical diagram of an ignition system for a multicylinder internal combustion engine and broadly illustrates implementation of the voltage distributor of the invention.

FIG. 3 is a schematic diagram of an embodiment of the invention utilizing a voltage distributor formed from a binary counter, a decoder and a plurality of relays.

DETAILED DESCRIPTION

Figure 2:
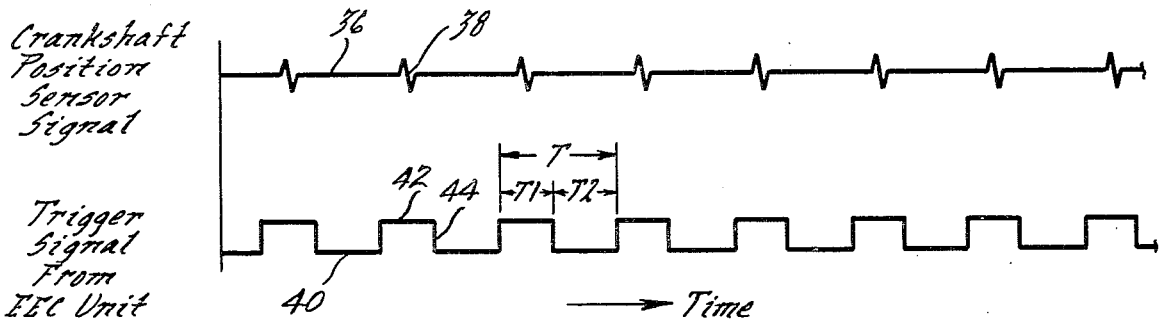
FIG. 2 illustrates waveforms for a crankshaft position sensor signal and a trigger pulse signal usable in the ignition system of FIG. 1.

With reference now to the drawings, wherein like numerals refer to corresponding items in the several views, there is shown in FIG. 1 a schematic electrical diagram of an ignition system for a multicylinder spark ignition internal combustion engine.

The system 10 of FIG. 1 includes a DC source of electrical energy 12, which may be a conventional motor vehicle storage battery. The battery 12 has its negative terminal connected to ground and has its positive terminal connected by a lead 14 to the battery terminal 16 of an ignition coil 18. Ignition coil 18 has a primary winding 20 connected to terminal 16, a secondary winding 22 and a terminal 24 connected to the junction formed between the primary and secondary windings. Terminal 24 is connected by a lead 26 to an electronic ignition module 28 having a ground connection 30 and a trigger input terminal 32.

The electronic ignition module 28 may be a conventional breakerless ignition module utilized to repetitively make and break electrical contact between lead 26 and ground thereby to cause periodic current flow and interruption in the ignition coil primary winding 20. Each interruption of current flow through the primary winding produces a voltage pulse on lead 34 connected to the upper terminal of the secondary winding 22. The voltage pulse typically ceases or is substantially decayed before the electronic ignition module again establishes electrical contact between lead 26 and ground lead 30 to cause current again to flow through the primary winding. The ignition dwell time is the length of time that current flows through the primary winding and the anti-dwell time is the length of time such current does not flow. The high-voltage pulses on lead 34 occur during the anti-dwell time of each ignition cycle. The trigger input on lead 32 controls the dwell and anti-dwell times as well as the repetition rate of the voltage pulses occurring on lead 34.

The trigger input at terminal 32 could be obtained from a conventional set of breaker points operated by a cam driven in synchronizism with engine operation. The cam would have one lobe for each spark to be generated over a complete engine cycle (two crankshaft revolutions for a four-stroke engine), and the sequence of pulses would represent and control the engine firing order. It is preferred, however, that the trigger pulses applied to terminal 32 be obtained from an electronic engine control (EEC) unit, such as the EEC unit now used on the 1978 model Lincoln Versailles manufactured by the assignee of the present invention.

FIG. 2 illustrates pulse waveforms generated in a system of the type used in the 1978 Lincoln Versailles. The EEC unit on this vehicle is used in association with a crankshaft position sensor that produces the waveform 36 comprising a series of alternating pulses 38. The crankshaft position sensor is a permanent magnet pulse pick-up device that senses notches or projections in a device rotating at crankshaft speed. Preferably, one pulse 38 is produced for each spark to be generated in a spark plug associated with the engine. The pulses 38, after being shaped by a circuit such as that described in U.S. Pat. No. 3,801,830 issued to Wesley D. Boyer, is supplied to the EEC unit. With this and other information provided, the EEC unit develops the signal 40 which is applied to terminal 32 of the electronic ignition module 28.

The signal 40 is a voltage waveform comprising a series of trigger pulses 42 which occur at a pulse repetition frequency corresponding to the rate at which sparks are to be sequentially generated in the engine spark plugs. The signal 40 is periodic with a period T. The period T is subdivided into the trigger pulse (anti-dwell) time T1 and the dwell time T2.

During each trigger pulse 42, having the duration T1, a transistor within the electronic ignition module 28 is rendered nonconductive to prevent current flow between lead 26 and lead 30, thereby, to interrupt current flow through the primary winding 20 of the ignition coil 18. This produces a voltage pulse on lead 34 which terminates prior to the negative-going edge 44 of the trigger pulse 42. Upon the occurrence of the edge 44, the transistor in the module 28 is rendered conductive to again start the dwell time represented by current flow through the primary winding 20.

The voltage pulses on lead 34 are applied as the input to a switch 46 (FIG. 1) forming part of the voltage distributor of the invention. Switch 46 has eight output leads 48*a* through 48*h* connected to gaps 50 in the spark plugs of the engine. Eight spark plug gaps are illustrated, each gap being sequentially broken down in accordance with the firing order of the engine by the high voltage pulses appearing on lead 34. A greater or lessor number of spark gaps and associated circuitry may be provided as required in a given engine application.

The switch 46 sequentially connects lead 34 with the switch output leads 48*a* through 48*h* and then repeats the sequence. When electrical contact is made between lead 34 and switch output lead 48*b*, electrical contact is broken between lead 34 and switch output lead 48*a*. Similarly, contact between lead 34 and output lead 48*b* is broken when contact is made between lead 34 and lead 48*c*, etc.

The switching action produced by switch 46 is controlled by steering logic and decoder means 52, which also may include a synchronizer. The function of the steering logic and decoder is to produce signals on leads 54*a* through 54*h* in a sequence corresponding to the desired making and breaking of electrical contact between lead 34 and switch output terminals 48. A driver circuit 56, which may consist of a number of individual power transistors, may be interconnected between leads 54 and input leads 58*a* through 58*h* of switch 46 for the purpose of amplifying the signals on leads 54 to a power level sufficient to control switch 46 through input leads 58.

The steering logic and decoder 52 has an input terminal 60 to which the trigger pulses 42 are applied. The function of the circuitry 52 is to decode these signals and to steer the resulting output control signals sequentially to the output leads 54*a* through 54*h* by means of which the switch 46 is controlled.

Each trigger pulse applied to terminal 60 causes the switch 46 to break a contact between the secondary winding output lead 34 and one of the switch output terminals 48 and to make another contact between the winding output terminal and another of these switch output terminals. Whenever signal 40 switches from the logic one state through negative-going edge 44, the existing contact switch 46 is broken and the next contact, in the predefined order, is established. Thus, when the leading or positive-going edge of pulse 42 occurs and the resultant high voltage is generated on lead 34, the switch 46 is already in its properly contacted state. The voltage-distribution switching function is distinct and separate from the spark generation function, and these functions occur at the different times determined by the leading and trailing edges of pulse 42.

If desired, the circuitry 52 may include synchronization means to assure that not only do the sparks in the various spark plugs occur in a sequence corresponding to the engine firing order, but also that the sparks occur in the right spark plug at the right time. For this purpose, a cam 62 driven by the engine's camshaft may be used in association with a magnetic pick-up 64 to produce a pulse, which after application to a pulse shaping amplifier 66 preferably of the type described in the aforementioned Boyer U.S. Pat. No. 3,801,830, is applied to synchronization means in the circuitry 52. The synchronization means insures that the switch 46 is in a predetermined condition upon occurrence of the pulse provided by the pulse shaping amplifier 66 at the predetermined position of the cam 62.

With particular reference now to FIG. 3, there is shown synchronization, steering logic and decoder circuitry 52 that includes a binary counter 70 and a decoder 72. Leads 74, 76 and 78 interconnect the binary counter with the decoder.

Trigger pulses 42 are applied to the trigger input 60 of the binary counter. The binary counter 70 preferably is of the RCA Corporation type CD 4024 as indicated in FIG. 3 and is capable of counting from zero to seven with the binary count in the counter being incremented on the negative-going edge of each pulse applied to terminal 60. Thus, binary counter 70 is incremented on the edges 44 of the pulses 42, which edges occur just after a high-voltage pulse and spark have been produced in the ignition system and at the beginning of the dwell time. The synchronization means of the FIG. 3 circuitry includes the reset input R of binary counter 70, which causes a zero count to be stored in the counter each time a pulse is produced by the pulse shaping amplifier 66. Since the pulse from the amplifier occurs once per camshaft revolution, one complete engine cycle takes place before this pulse is produced to reset the binary counter. Under normal circumstances, the counter 70 will already be at a zero count state.

Each pulse 42 applied to input terminal 60 of the binary counter 70 increments the counter by one count. At all times, the count in the counter is represented on the output leads 74, 76 and 78 in the form of a three-bit binary number. With these three-bits, binary numbers from zero to seven are represented, a total of eight different numbers. The decoder 72 receives these numbers and, in the usual manner and depending upon the number represented on leads 74, 76 and 78, activates one of the leads 80*a* through 80*h*. Each successive pulse applied to input terminal 60 causes a different one of the decoder 72 output lines 80 to be energized or activated. In other words, if a count of zero is present in the binary counter, decoder output line 80*a* may be activated. If a count of one is represented on the counter output lines, decoder output line 80*b* may be activated. This process continues until a binary number seven appears on leads 74, 76 and 78, the decoder 72 output line 80*h* is activated. The next pulse applied to terminal 60 causes the binary counter count state to return to zero and results in activation of decoder output line 80*a*. Were the binary counter not to return to zero, the aforementioned pulse applied to the counter reset input R would reset the counter to the zero count state to assure synchronization of the voltage distributor system.

The driver circuit 56 is supplied with the signals appearing on lines 80. If line 80*a* is activated, then a positive voltage appears on driver circuit output lead 58*a*, and if decoder output line 80*b* is activated, driver circuit output lead 58*b* acquires a positive voltage, etc.

The circuitry in FIG. 3 that corresponds to the switch 46 of FIG. 1 comprises eight electromagnetic relays 82. Each of these relays preferably is an electromagnetically-activated, high-voltage reed switch having a pole 84 connected to the high-voltage output lead 34 from the secondary winding 22 of the ignition coil and having a second pole 86 connected to a spark plug 50. The electrodes or poles 84 and 86 are enclosed by an evacuated glass housing 90 around which may be would an electrical coil 88 connected between the driver circuit 56 and ground potential. When a voltage signal appears on lead 58, current flows through the coil 88 which then has sufficient ampere-turns to actuate the movable pole 86 of the relay 82. When this occurs, the high-voltage pulse from the secondary winding thereafter appearing on lead 34 is distributed to the spark plug associated with the relay 82 having a set of closed switch elements 84, 86.

After a spark is produced in one of these spark plugs 50 as a result of current flow through the closed contacts of a relay 82, the circuitry of FIG. 3 causes this relay to become nonconductive and causes a second relay 82 then to become conductive, thereby, to permit a spark to occur in a different spark plug. The sequence continues in accordance with the engine firing order.

Figure 4:
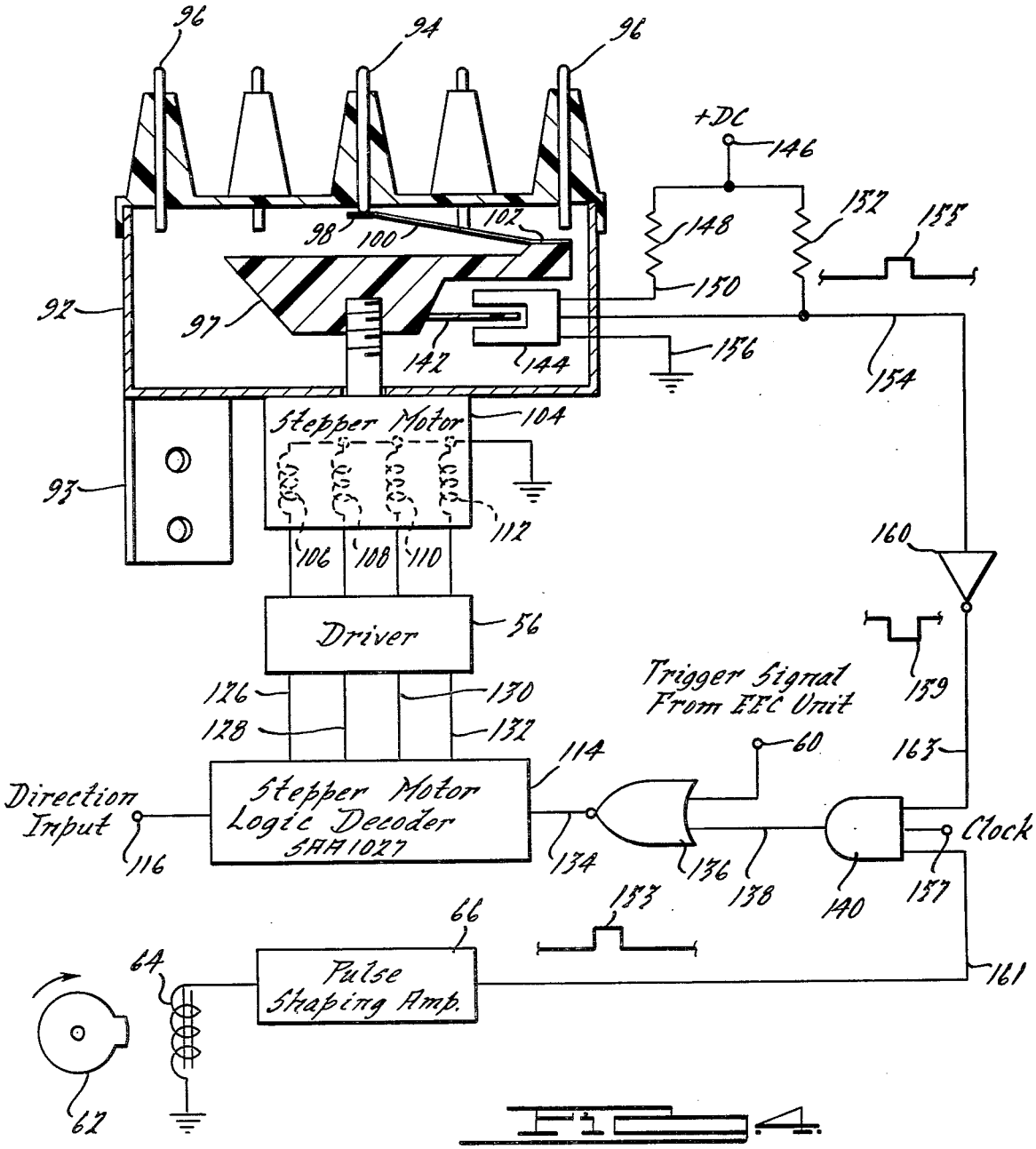
FIG. 4 is a diagrammatic view of a voltage distributor utilizing a rotary distributor switch and steering logic and decoder means in the form of a stepper motor and a stepper motor logic decoder.

With particular reference now to FIG. 4, there is shown an alternative embodiment of the invention wherein a rotary switch, generally designated by the numeral 92, is used. The switch 92 may be mounted in any convenient location by means of the holding bracket 93. The rotary switch 92 has a central electrode 94 and radially and equally spaced switch output terminals 96 connected by leads (not shown) to the spark plugs 50 of the engine. A rotor 97 has an electrically conductive element 100 that forms or makes an electrical contact at 98 with the central electrode 94. A portion 102 of the conductive element 100 makes arc-gap electrical contact with the distributor output terminals 96 as the rotor 97 is driven by a stepper motor 104.

The stepper motor 104 has four windings 106, 108, 110 and 112 that are controlled, through a driver circuit 56, by a stepper motor logic decoder 114. The stepper motor logic decoder 114 has output leads 126, 128, 130 and 132 coupled, respectively, to stepper motor windings 106, 108, 110 and 112 through driver circuit 56. A suitable stepper motor logic decoder is commercially available and may be of the North American Phillips type SAA 1027 as indicated in FIG. 4. A terminal 116 is provided thereon to control, by the application of a positive DC or ground voltage, the direction of rotation of the stepper motor.

The decoder also has an input lead 134. Each time a pulse occurs on lead 134, the stepper motor logic decoder 114 energizes a different pair of its output leads 126, 128 130 and 132 causing the driver circuit 56 to energize a corresponding pair of the stepper motor windings 106, 108, 110 and 112. Each time a pair of stepper motor windings is energized, the stepper motor causes the rotor 97 to index from alignment of the conductive portion 102 with one of the distributor output terminals 96 to alignment with another such output terminal, the next in the sequence according to engine firing order.

The pulses on lead 134, the input to the stepper motor logic decoder 114, are obtained from the output of a NOR-gate 136 which has the trigger pulses from the EEC unit as one of its inputs at terminal 60. The other input to the NOR-gate 136 is obtained on lead 138, which is the output of an AND-gate 140.

The rotor 97 has an extending member 142 that enters a slot in a photodiode-transistor pair 144. Only when the portion 102 of the conductive element 100 is in alignment with the distributor output terminal 96, as shown in the drawing of FIG. 4, is light transmission between the photodiode and transistor blocked by the member 142. When the rotor 97 is in any other position, light transmission between these components is not blocked. The photodiode-transistor pair are commercially available and may be of the General Electric type H17A1.

A positive DC voltage is applied to terminal 146 and through resistor 148 is connected to the anode of the photodiode whose cathode is connected to a ground lead 156. The emitter of the NPN transistor in the package 144 also is connected to ground, and its collector is connected to the source of voltage at terminal 146 through a current limiting resistor 152. The resistor 152 collector junction is connected to lead 154 and, once per revolution of the rotor 97 and when the rotor 97 is in the illustrated position, the collector voltage at terminal 154 produces the pulse shown at 155. This pulse is inverted by an inverter 160 to produce the pulse 159 applied to one input of the AND-gate 140. The other input to the AND-gate 140 is a pulse 153 produced at the output of the pulse shaping amplifier 66 once per camshaft revolution as previously described. Clock pulses, at a frequency substantially greater than the frequency of the trigger pulses applied to terminal 60, are applied to the input terminal 157 of the AND-gate 140.

As long as a logic zero level appears on output lead 138 of the AND-gate 140, the trigger pulses applied to terminal 60 of NOR-gate 136 appear on lead 134. These trigger pulses 42 are initiated on the negative-going edge 44 of signal 40 (FIG. 2) that corresponds to the onset of the dwell time. When this negative-going edge occurs, a positive-going edge occurs on lead 134 to change the voltage pattern on the output leads of the stepper motor logic decoder 114 and, thereby, to cause the stepper motor 104 to rotate and change the position of the rotor 97.

If pulse 153 does not coincide with pulse 159, then, for the duration of pulse 153, both inputs 161 and 163 to the AND-gate 140 are at a logic one level so that the clock pulses at terminal 157 pass through AND-gate 140 and appear at input 138 to the NOR-gate 136. Between trigger pulses at terminal 60, that is, when terminal 60 is at a logic zero level, the pulses appearing on input lead 138 are transmitted through the gate 136 and appear on lead 134 to cause the stepper motor to drive the rotor 97 until the pulses 153 and 159 coincide, that is, until synchronization occurs.

It should be understood that the gates 136 and 140 and the associated inputs are provided for synchronization purposes and are not essential for operation of the voltage distributor of the invention. The trigger pulses at terminals 60 could be applied, through an inverter if necessary to the terminal 134 to produce stepper motor rotation. If the motor 97 were properly synchronized with desired engine spark sequencing upon initial voltage distributor installation, it is possible that this synchronization would remain throughout the use of the device and means for assuring synchronization would therefore be unnecessary. This would mean that the devices 62, 64, 66, 142, 144, 148, 152, 160, 140 and 136 could be eliminated.

Based upon the foregoing description of the invention, what is claimed is:

1. A voltage distributor for a spark ignition internal combustion engine having a camshaft, a plurality of combustion chambers, and at least one spark plug for each of said combustion chambers, said distributor supplying voltage to said spark plugs in a sequence corresponding to the firing order of said engine, said distributor comprising:

an ignition coil having primary and secondary windings, said secondary winding having an output lead;

switch means having a plurality of output leads each of which is connected to a different one of said spark plugs, said switch means being controllable to cause said secondary winding output lead sequentially to make and break electrical contact with said switch means output leads in a sequence corresponding to the firing order of said engine;

trigger means, coupled to said primary winding, for causing voltage pulses to occur on said secondary winding output lead, said voltage pulses having a magnitude sufficient to produce a spark discharge in the spark plug to which said secondary winding output lead is electrically connected through said switch means, said trigger means generating trigger pulses at a repetition frequency equal to the repetition frequency of said voltage pulses;

a stepper motor and a stepper motor decoder, said stepper motor decoder causing said stepper motor to rotate a predetermined amount upon the occurrence of each of said trigger pulses and said stepper motor controlling said switch means, thereby, to cause said sequential making and breaking of electrical contact;

means for generating a synchronizing pulse for each revolution of the camshaft of said engine;

means for generating an electrical signal when said stepper motor is in a predetermined position relative to a predetermined switch means output lead; and gate circuit means for allowing clock pulses to be applied to said stepper motor decoder until said synchronizing pulse and electrical signal simultaneously occur.

* * * * *